United States Patent [19]

Tsuji et al.

[11] Patent Number: 4,972,926

[45] **Date of Patent: * Nov. 27, 1990**

[54] HALL INFORMATION SYSTEM FOR ELEVATOR

[75] Inventors: Shintaro Tsuji; Kenichi Uetani, both of Inazawa, Japan

[73] Assignee: Mitsubishi Denki Kabushiki Kaisha, Tokyo, Japan

[ * ] Notice: The portion of the term of this patent subsequent to Jun. 27, 2005 has been disclaimed.

[21] Appl. No.: 869,887

[22] Filed: Jun. 3, 1986

[30] Foreign Application Priority Data

Jun. 4, 1985 [JP] Japan ..... 60-121156

[51] Int. Cl.[5] ..... B66B 3/00

[52] U.S. Cl. ..... 187/137; 187/121

[58] Field of Search ..... 187/29 R, 121, 137, 187/127; 340/19 R, 20

[56] References Cited

U.S. PATENT DOCUMENTS

| | | | |
|---|---|---|---|
| B 341,322 | 1/1975 | Iwasaka et al. | 340/19 R |
| 2,148,913 | 2/1939 | Stevens | 340/20 |
| 2,980,886 | 4/1961 | Yeakley | 340/19 R |
| 3,110,879 | 11/1963 | Nikazy | 340/20 |
| 3,374,864 | 3/1968 | Port | 187/29 R |
| 4,600,087 | 7/1986 | Tsuji | 340/20 X |

FOREIGN PATENT DOCUMENTS

| | | |
|---|---|---|
| 52-7549 | 1/1977 | Japan . |
| 53-40893 | 10/1978 | Japan . |
| 60-31484 | 2/1985 | Japan . |

*Primary Examiner*—James L. Rowland
*Assistant Examiner*—Brian R. Tumm
*Attorney, Agent, or Firm*—Leydig, Voit & Mayer

[57] ABSTRACT

A hall information system for an elevator having a hall operation panel including a plurality of destination buttons corresponding to a plurality of destination floors. Hall and destination calls are registered in response to the actuation of the destination buttons so as to combine destination calls into at least one group in each of up and down directions, and a cage is then assigned to serve a particular group of destination calls. An information unit is provided in each hall providing a cage arrival display having hall lanterns and/or chimes controlled in response to each subsequent actuation of the destination button and cage assignment to indicate a change in hall and destination calls and cage arrival display.

10 Claims, 6 Drawing Sheets

HALL INFORMATION SYSTEM FOR ELEVATOR

BACKGROUND OF THE INVENTION

This invention relates to improvements in a hall information system for a group-supervisory elevator wherein destination buttons for registering destination floors are disposed in halls.

Usually, an elevator is so constructed that a hall call is registered with an up button or a down button disposed in a hall and that a cage is called to the hall in accordance with the hall call. In addition, the hall is furnished with a hall lantern (hereinbelow, termed 'HL') and a chime for each cage. When a cage is assigned to serve the registered hall call the HL is lit up and the chime is rung in a single tone to notify the users waiting in the hall. When the cage arrives at the hall, the HL is flashed and the chime is rung in a multiple tone for reporting the arrival of the cage and the traveling direction thereof. The users then get into the arriving cage and register cage calls with a destination button disposed in the cage. In this manner, in the conventional elevator, the call buttons need to be manipulated in the hall and the cage respectively.

Meanwhile, as disclosed in Japanese Utility Model Registration Application Publication No. 53-40843 by way of example, a system has recently been proposed wherein destination buttons similar to those in cages are disposed in a hall commonly for the respective cages and wherein destination floor display units are disposed in the hall for the respective cages. With this system, when waiting users have manipulated the hall destination buttons to register calls for destination floors, the cages are assigned to the respective destination calls, and the floors of the allotted destination calls are displayed on the destination floor display units, thereby to report the assigned cages to the waiting users who have depressed the hall destination buttons and also to inform the other waiting users of the destination floors of the respective cages. In this case, as soon as the destination call has been allotted, it is automatically registered as the cage call of the assigned cage, and hence, the user or passenger can dispense with the trouble of depressing the destination button in the cage. Moreover, the system is very convenient because it eliminates the drawback of having to depress the destination button when the cage is very crowded.

The destination floor display units described above, however, are too expensive when they are disposed in the respective floors and for the respective cages, and pose a problem in practical use.

As disclosed in Japanese Patent Application Laid-open No. 60-31484, therefore, it has been devised that a hall is furnished with only up and down HL's and chimes without disposing destination floor display units and that registered destination calls are classified in an up direction and a down direction into a group of up calls and a group of down calls, to each of which one cage is assigned. Likewise to the conventional case where the up button and the down button are disposed, the HL of the assigned cage is lit up and the chime thereof is rung, thereby to inform waiting users of the service cage in advance, and when the assigned cage has arrived, the group of destination calls is collectively registered as cage calls. Since, in this case, cages are not assigned to the respective destination calls, the display of destination floors is unnecessary, and the waiting users can be informed of the cage in which they are to use, namely, the cage in which the cage calls of the desired floors of the users are to be automatically registered, by the lighting of the HL and the ringing of the chime before the arrival of the cage.

However, in a case where the first waiting user has already registered the up call or down call and where the cage has been assigned thereto to serve a group of destination floors including the destination floor requested by a second user, the information display remains unchanged, and the second waiting user is uncertain whether the assigned cage will serve his/her requested destination floor, and, as a result, the second user feels anxiety as to the stoppage of the cage at his/her requested destination floor until he/she actually registers a cage call.

SUMMARY OF THE INVENTION

This invention has the objective of overcoming the problem as described above, and has for its main object to provide, a hall information system for an elevator capable of reducing anxiety of passengers waiting in the halls.

A hall information system according to this invention can be utilized in an elevator wherein the hall of a floor to be served by a plurality of cages is furnished with destination buttons, and the cage calls of destination floors corresponding to the destination buttons are automatically registered for any of the cages, and wherein the destination floors in an up direction or those in a down direction are combined into groups so as to register calls for the respective groups in accordance with the destination buttons by call registration means, and comprises information units operable on the basis of assignment signals from an assignment means for assigning cages to respective registered group cells and call registration signals corresponding to destination floors provided by the call registration means each time a call registration signal is output anew.

In the hall information system for an elevator according to this invention, when a new destination floor is registered by the destination button in the hall, the information unit is operated again to display the corresponding assigned cage where the new destination floor belongs to the same group of destination floors previously registered to be served by the assigned cage.

Brief Description of the Drawings

In the drawings, the same symbols indicate identical or corresponding portions.

DESCRIPTION OF THE PREFERRED EMBODIMENT

Referring now to FIGS. 1–8, this invention will be described for an embodiment in which two cages are installed in a 5-story building.

Figure 1:
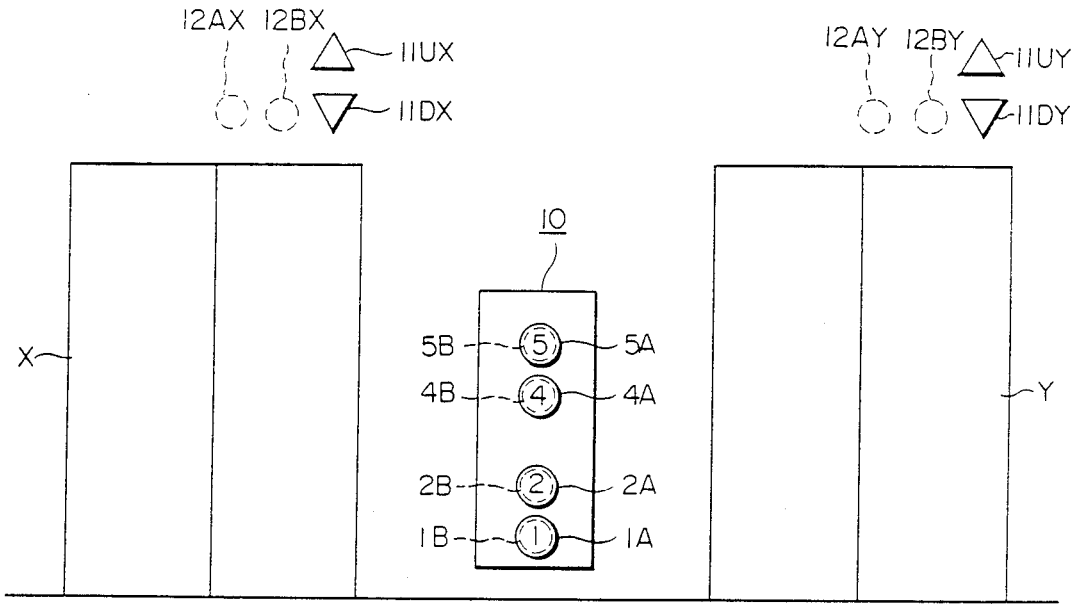
FIG. 1 is a front view of the hall doors of an elevator.

In FIG. 1, letters X and Y indicate the hall doors of cages No. 1 and No. 2, respectively. Hall destination buttons 1A, 2A, 4A and 5A register destination calls respectively corresponding to the first floor, second floor, fourth floor and fifth floor commonly for the cages No. 1 and No. 2, and they are arrayed in a hall operation panel 10 disposed in the hall of the third floor. Destination button lamps 1B, 2B, 4B and 5B are respectively built in the destination buttons 1A, 2A, 4A and 5A, and are respectively lit up when destination calls for the first floor, second floor, fourth floor and fifth floor have been registered. The down lamps 11DX and 11DY of the HL's of the cages No. 1 and No. 2 are respectively disposed over the hall doors X and Y, while the up lamps 11UX and 11UY are similarly disposed, and preannouncement chimes 12AX and 12AY which ring in a single tone are similarly disposed, while arrival chimes 12BX and 12BY which ring in a double tone are similarly disposed.

Figure 2:
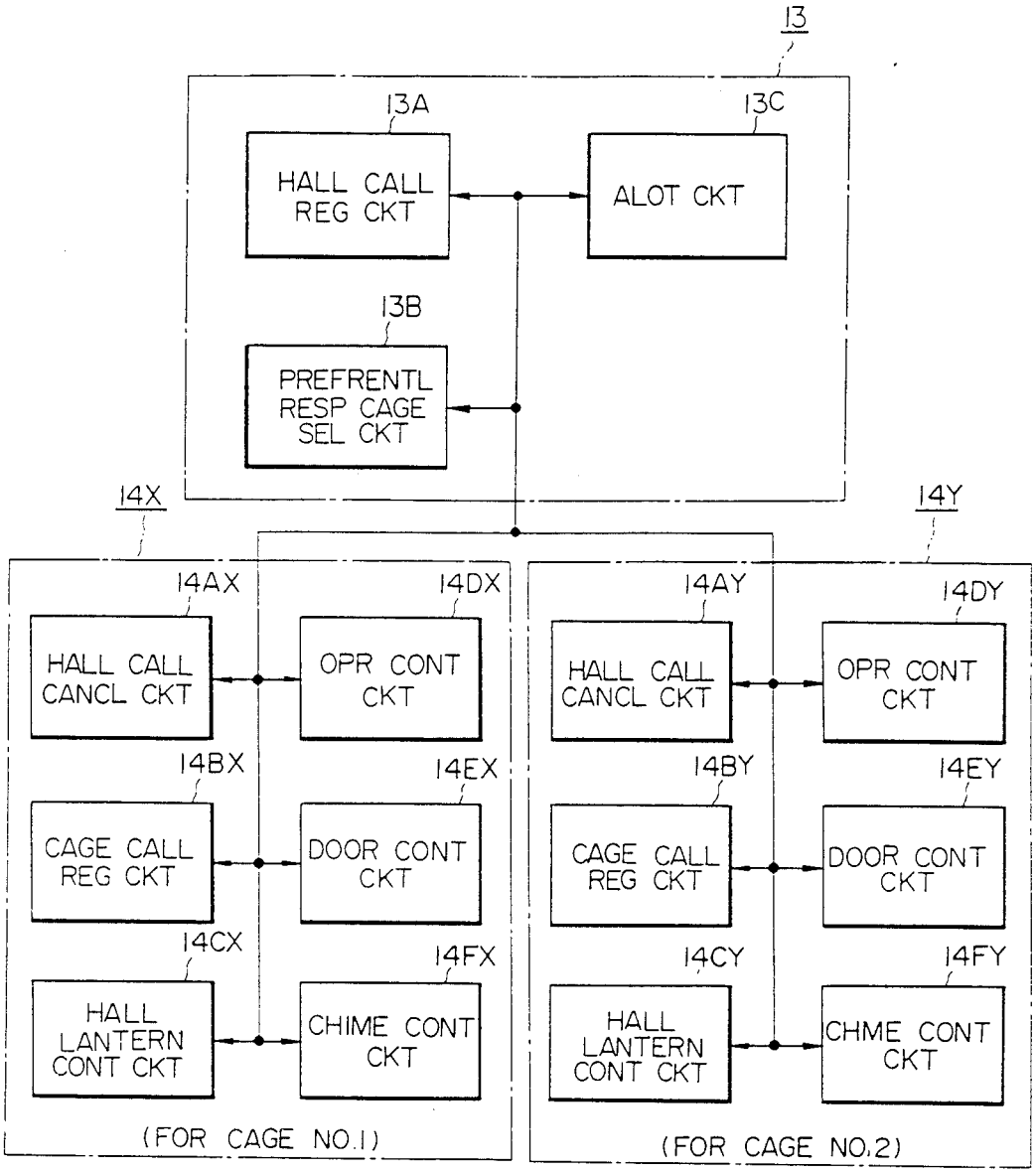
FIG. 2 is a general system diagram of the control circuits of the elevator.

In FIG. 2, a group supervision device 13 comprises a hall call registration circuit 13A which registers the hall calls (up calls, down calls and destination calls) of the respective floors, a preferential response cage selection circuit 13B which selects a preferential response cage that preferentially responds to the hall calls so as to automatically register cage calls, and a well-known allotment circuit 13C which selects a cage most suited to respond to the hall call and allots the hall call thereto. By way of example, the allotment circuit 13C predictively calculates the periods of time required for the respective cages to respond to the hall calls of the respective floors and assigns the cage having the shortest response time. Symbols 14X and 14Y denote cage control devices for the cages No. 1 and No. 2, respectively. The cage control devices 14X and 14Y comprise the following constituents with the respective suffixes X and Y: Hall call cancellation circuits 14AX and 14AY deliver the hall call cancellation signals (to be described later) of the respective floors, cage call registration circuits 14BX and 14BY register the cage calls of the respective cages, HL control circuits 14CX and 14CY control the lighting of the HL's of the respective floors for the respective cages, well-known operation control circuits 14DX and 14DY control basic operations such as the run and stop of the cages in order to cause the respective cages to respond to cage calls and allotted hall calls, well-known door control circuits 14EX and 14EY control the opening and closure of the doors of the respective cages, and chime control circuits 14FX and 14FY control the ringing of the preannouncement chimes and arrival chimes of the respective floors for the respective cages.

In FIGS. 3–8, symbols 11UXA and 11UXB denote lamps disposed within the up lamp 11UX of the third floor for the cage No. 1, in which the lamp 11UXA is a white lamp and the lamp 11UXB is a red lamp. Symbol 24BX denotes the cage call button signal of the fourth floor which becomes "H" (high level) when a destination button (not shown) for the fourth floor disposed in the cage No. 1 is depressed, and symbol 24X the cage call registration signal of the fourth floor which becomes "H" when the cage call of the cage No. 1 for the fourth floor is registered. The cage call button lamp 24LX of the fourth floor is built in the destination button of the cage No. 1 for the fourth floor and is lit up when the cage call of the fourth floor is registered. Numerals 301, 302, 304 and 305 designate destination call registration signals which become "H" when destination calls for the first floor, second floor, fourth floor and fifth floor are registered with the hall destination buttons 1A, 2A, 4A and 5A of the third floor, respectively. Numerals 104, 204 and 504 designate destination call registration signals for the fourth floor which are based on the hall operation panels (not shown) of the first floor, second floor and fifth floor, respectively. An up call registration signal 33U and a down call registration signal 33D become "H" when an up call and a down call on the third floor are registered, respectively. Symbol 33UX denotes an up assignment signal which becomes "H" when the cage No. 1 is assigned to the up call 33U of the third floor, symbol 33DX a similar down assignment signal and symbol 33UY a similar up assignment signal for the cage No. 2, and these signals are set by the allotment circuit 13C. Symbols 41X–45X denote cage position signals which become "H" when the cage No. 1 lies on the first–fifth floors, respectively, and symbol 43Y denotes a similar cage position for the cage No. 2 on the third floor. An at-stop signal 50X becomes "H" when the cage No. 1 is at a stop. An up direction signal 51UX becomes "H" when the cage No. 1 is operated in the up direction, while a similar up direction signal 51UY is of the cage No. 2, and they are respectively set by the operation control circuits 14DX and 14DY. A full closure signal 54X becomes "H" when the cage door of the cage No. 1 is fully closed. An up call cancellation command signal 55UX and a down call cancellation command signal 55DX become "H" when the cage No. 1 cancels the up call and down call of the third floor, respectively, while an up call cancellation command signal 55UY and a down call cancellation command signal 55DY similar to the above are of the cage No. 2, and they are respectively set by the hall call cancellation circuits 14AX and 14AY. Symbol 56UX denotes an arrival display timing setting circuit which is diposed in the HL control circuit 14CX and controls the arrival information display timing of the up lamp 11UX of the third floor for the cage No. 1, and which delivers an up arrival display command signal 56UX*a* that becomes "H" at the timing for the cage No. 1 to present the arrival information display of the up direction on the third floor. Shown at 56DX*a* is a down arrival display command signal similar to the above. Symbol 58X indicates an arrival display status setting circuit which is disposed in the HL control circuit 14CX and controls the arrival information display status of the HL 11UX of the third floor, and which delivers an arrival display status command signal 58X*a*. The circuit 58X includes a pulse generator 58AX which produces a periodic pulse signal that repeats "H" and "L (low level)" every 0.5 second, and a pulse generator 58BX which produces a periodic pulse signal that becomes "H" for 3 seconds and "L" for 0.5 second. A door opening/closure command signal 59X becomes "H" when closing the door of the cage No. 1 and becomes "L" when opening the same, and it is set by the door control circuit 14EX. Symbol 61X indicates a call response process signal which becomes "H" while the cage No. 1 is responding to the cage call (during a period from the time of the determination of stoppage through the opening of the door till a time immediately before the completion of the closure of the door), while symbol 61Y indicates a similar call response process signal for the cage No. 2. Numerals 801–809 indicate R-S flip-flops (hereinbelow, termed 'memories'). A pulse generator 810 produces a pulse signal that becomes "H" for a short time interval (e.g., 2 seconds) when the input signal of a point I has become "H", while similar pulse generators 811A–811D and 812 produce pulse signals that become "H" for a short time interval (e.g., 0.5 second) when the input signals of the point I have become "H". A selection circuit 813 selects one preferential response cage from among the cages which have arrived. Numerals 821–846 indicate AND gates, numerals 851–862 indicate OR gates, symbol **861*a* indicates the output signal of the OR gate 861, and numerals 871–877 indicate NOT gates. Symbols 91UX–93UX denote up preferential response cage signals which become "H" when the cage No. 1 is selected as the preferential response cage in the up direction in the halls of the first–third floors respectively, symbols 93DX and 95DX denote similar down preferential response cage signals on the third and fifth floor respectively, and symbol 93UY denotes a similar up preferential response cage signal on the third floor for the cage No. 2**.

Next, the operation of this embodiment will be described.

Assuming now that the cage No. 1 is at the second floor and in the up direction and that the cage No. 2 is at the first floor in the up direction, the third-floor cage position signal 43X is "L" in a circuit for the third floor (FIG. 5) within the hall call cancellation circuit 14AX of the cage No. 1. Therefore, all the outputs of the AND gates 827–829 are "L", and both the up call cancellation command signal 55UX and down call cancellation command signal 55DX of the third floor are "L". Likewise, the third-floor up call cancellation command signal 55UY and down call cancellation command signal 55DY of the cage No. 2 are "L". In addition, the third-floor cage position signal 43Y of the cage No. 2 is "L" in a circuit for third-floor up-direction use (FIG. 4) within the preferential response cage setting circuit 13B. Therefore, both the outputs of the AND gates 821 and 822 become "L", and both the outputs of the NOT gates 871 and 872 become "H", so that both the third-floor up preferential response cage signals 93UX and 93UY of the cages Nos. 1 and 2 are "L".

It is assumed that a user first entering the hall of the third floor has depressed the destination button 4A of the hall operation panel 10 for the fourth floor. Since the output of the OR gate 851 is now "L", the memory 803 is set to put the destination call registration signal 304 of the fourth floor into "H", and the destination button lamp 4B is lit up to report that the destination call of the fourth floor has been registered. Besides, since the output of the OR gate 853 becomes "H", the memory 806 is set, and the up call registration signal 33U of the third floor becomes "H" to register the up call of the third floor. In the allotment circuit 13C, the cage No. 1 which is expected to respond to the up call of the third floor in the shortest time interval is assigned, and the up allotment signal 33UX of the third floor becomes "H". Then, in a circuit for the third floor (FIG. 8) within the chime control circuit 14FX of the cage No. 1, the output of the AND gate 843 becomes "H", and the pulse generator 811C produces the pulse signal which becomes "H" for 0.5 second. Consequently, the output signal of the OR gate 861 becomes the pulse signal which is "H" for 0.5 second, and the third-floor preannouncement chime 12AX of the cage No. 1 is rung in the single tone to aurally report that the cage No. 1 has been assigned. Meanwhile, in a circuit for third-floor up-direction use (FIG. 7) within the HL control circuit 14CX of the cage No. 1, the third-floor up arrival display command signal **56UX*a* is "L", and the output of the NOT gate 876 is "H", so that the output of the AND gate 836 becomes "H". Accordingly, the output of the OR gate 859 becomes "H", and the white lamp 11UXA built in the up lamp 11UX of the third floor for the cage No. 1 is lit up. Besides, when the pulse signal 861*a* becomes "H", the output of the AND gate 846 becomes "H", and the pulse generator 810 produces the pulse signal which becomes "H" for 2 seconds, so that the red lamp 11UXB built in the up lamp 11UX of the third floor for the cage NO. 1 is lit up. Accordingly, when the cage No. 1 has been assigned to the third-floor up call, the third-floor up lamp 11UX of the cage No. 1 turns 'on' the white lamp 11UXA and the red lamp 11UXB simultaneously for the first period of 2 seconds and thereafter turns 'on' only the white lamp 11UXA to report the assignment of the cage No. 1**.

Figure 3:
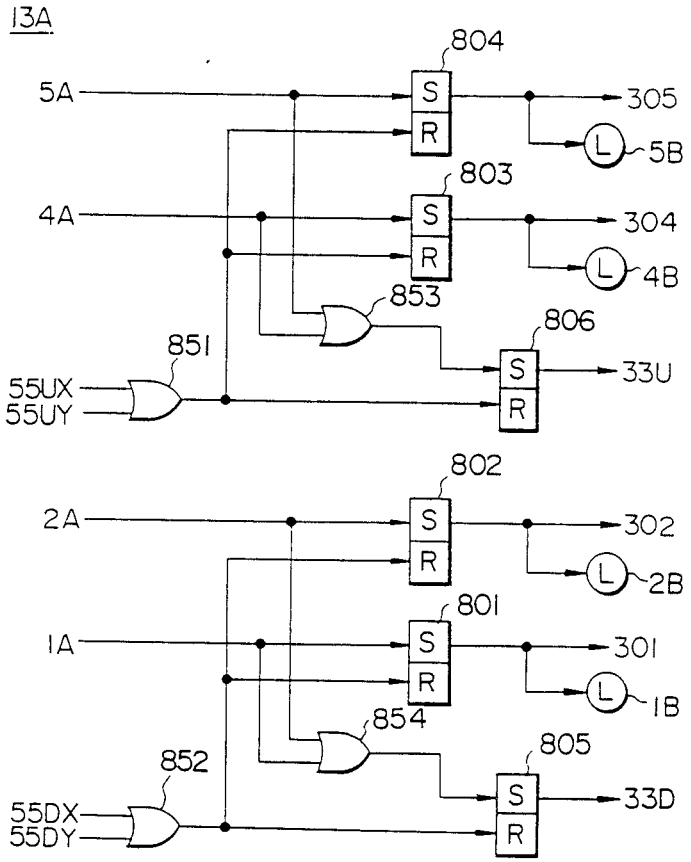
FIG. 3 is a circuit diagram of the portion of a hall call registration circuit corresponding to the third floor.

Next, it is assumed that a user destined for the fifth floor has depressed the destination button 5A on the third floor before the arrival of the cage No. 1 at the third floor. This time, the memory 804 in FIG. 3 is set to put the destination call registration signal 305 of the fifth floor into "H", with which the destination button lamp 5B is lit up to report that the destination call of the fifth floor has been registered. Simultaneously, in the circuit for the third floor (FIG. 8) within the chime control circuit 14FX of the cage No. 1, the third-floor up call registration signal 33U is already "H", and the up allotment signal 33UX is "H" owing to the assignment of the cage No. 1, so that the output of the AND gate 842 becomes "H" to produce the pulse signal being "H" for 0.5 seconds by means of the pulse generator 811D and to put the output signal **861*a* of the OR gate 861 into "H", whereby the third-floor preannouncement chime 12AX of the cage No. 1 is rung in the single tone again. Simultaneously, in the circuit for the third-floor up-direction use (FIG. 7) within the HL control circuit 14CX of the cage No. 1, when the pulse signal 861*a* becomes "H", the output of the AND gate 846 becomes "H", so that the output of the pulse generator 810 becomes "H" for 2 seconds, during which the red lamp 11UXB is lit up. Accordingly, the user destined for the fifth floor is informed of it by the sound and the change of the colors of the HL that he/she may get in the cage No. 1, so that he/she is prevented from missing the cage No. 1** when it arrives.

The situation is similar in a case where the destination buttons 2A and 1A in the down direction have been manipulated. Assuming that the down calls of the third floor have been allotted to the cage No. 1, the outputs of the AND gates 844 and 845 become "H" this time. After all, the preannouncement chime 12AX of the third floor rings in the single tone, and the colors of the down lamp 11DX change.

Next, the operation after the arrival of the cage at the hall will be described by taking as an example a case where the cage No. 1 being the cage assigned to the up call of the third floor has arrived at the third floor in the up direction.

Figure 4:
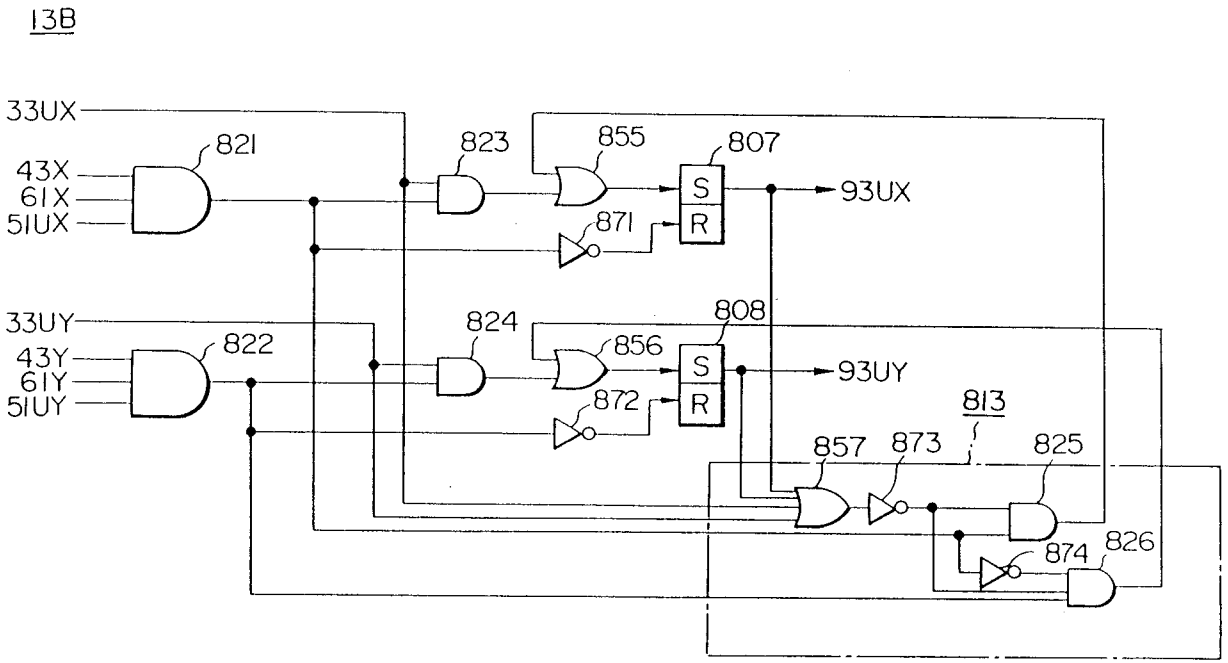
FIG. 4 is a circuit diagram of the portion of a preferential response cage selection circuit corresponding to the up direction of the third floor.
Figure 7:
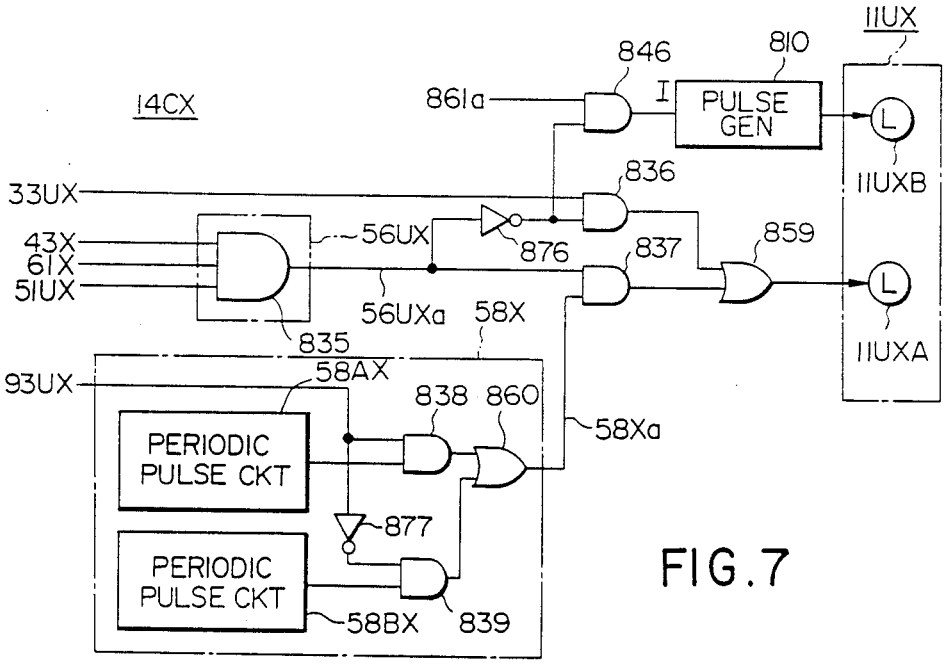
FIG. 7 is a circuit diagram of the portion of the HL control circuit of the cage No. 1 corresponding to the up lamp of the third floor.

When the cage No. 1 has reached the third floor after leaving the second floor, the third-floor cage position signal 43X becomes "H" in FIG. 4, and when the cage No. 1 has been allocated to stop in response to the up call of the third floor, the call response process signal 61X becomes "H". Since, at this time, the up direction signal 51UX is "H", the output of the AND gate 821 becomes "H" and that of the AND gate 823 becomes "H", so that the memory 807 is set through the OR gate 855. Thus, the third-floor up preferential response cage signal 93UX of the cage No. 1 becomes "H". In FIG. 7, the third-floor up arrival display command signal 56UX*a* being the output of the AND gate 835 becomes "H", and the output of the NOT gate 876 becomes "L", so that the outputs of the AND gates 836 and 846 become "L" to check the previous information display based on the up lamp 11UX. Meanwhile, in the arrival display status setting circuit 58X (FIG. 7), the output of the AND gate 838 becomes "H" for the period of 0.5 second for which the periodic pulse signal produced by the periodic pulse generator 58AX is "H", so that the arrival display status command signal 58X*a* becomes "H" through the OR gate 860. Besides, for the period of 0.5 second for which the periodic pulse signal is "L", the output of the AND gate 838 is "L", that of the NOT gate 877 is "L" and that of the AND gate 839 is "L", so that the arrival display status command signal 58X*a* being the output of the OR gate 860 becomes "L". After all, the output of the OR gate 859 becomes a signal which repeats "H" and "L" at cycles of 1 second ("H" for 0.5 second and "L" for 0.5 second) while the up arrival display command signal 56UX*a* is "H". The up lamp 11UX of the third floor flashes accordingly, to report that the cage No. 1 has arrived in the up direction.

Figure 8:
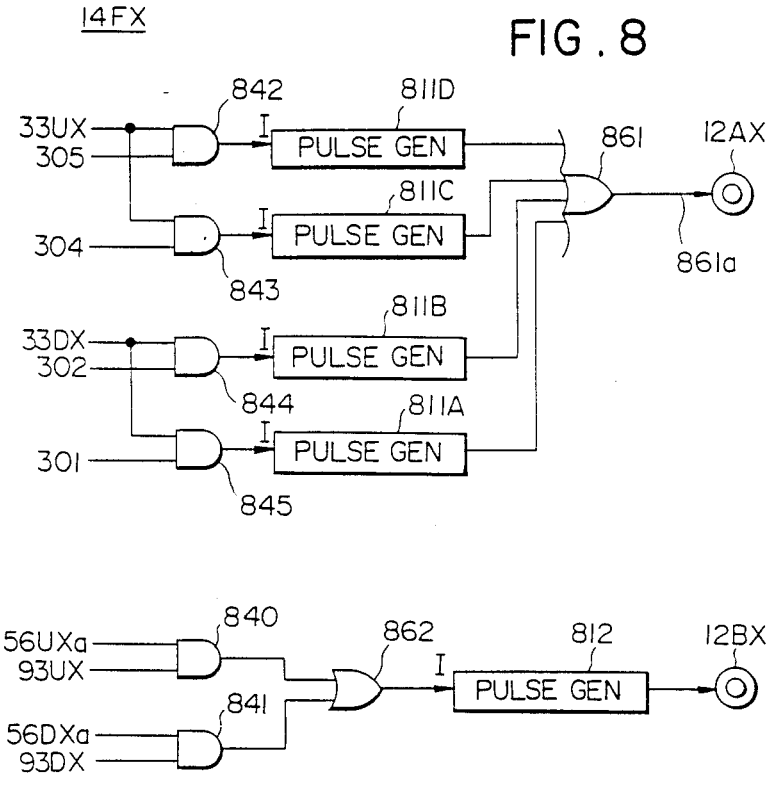
FIG. 8 is a circuit diagram of the portion of the chime control circuit of the cage No. 1 corresponding to the third floor.

In FIG. 8, when the arrival display command signal 56UX*a* becomes "H" and the up preferential response cage signal 93UX becomes "H", the output of the AND gate 840 becomes "H", and that of the OR gate 862 becomes "H". The pulse generator 812 accordingly produces a pulse signal which become "H" for 0.5 second and the third-floor arrival chime 12BX of the cage No. 1 is rung in the double tone, whereby the arrival of the cage is reported also aurally.

On the other hand, in a circuit for the fourth floor (FIG. 6) within the cage call registration circuit 14BX of the cage No. 1, when the cage No. 1 has reached the third floor in the up direction and the preferential response cage signal 93UX has become "H", the output of the AND gate 833 becomes "H" because the destination call registration signal 304 of the fourth floor is "H". Then, the output of the OR gate 858 becomes "H", the memory 809 is set, and the fourth-floor cage call registration signal 24X becomes "H". Thus, inside the cage No. 1, the cage call button lamp 24LX of the fourth floor is lit up to report that the cage call of the fourth floor has been automatically registered. Accordingly, when a user destined for the fourth floor has got in the cage No. 1 on the third floor, the cage call of the fourth floor has already been registered, and hence, the passenger need not depress the destination button in the cage.

Figure 5:
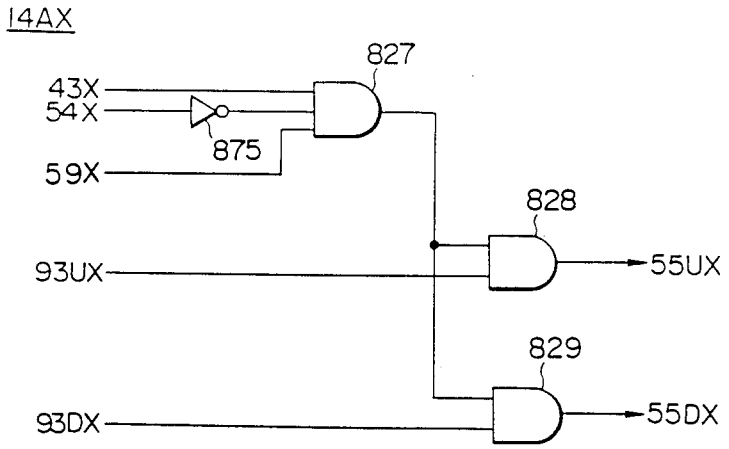
FIG. 5 is a circuit diagram of the portion of the hall call cancellation circuit of cage No. 1 corresponding to the third floor.
Figure 6:
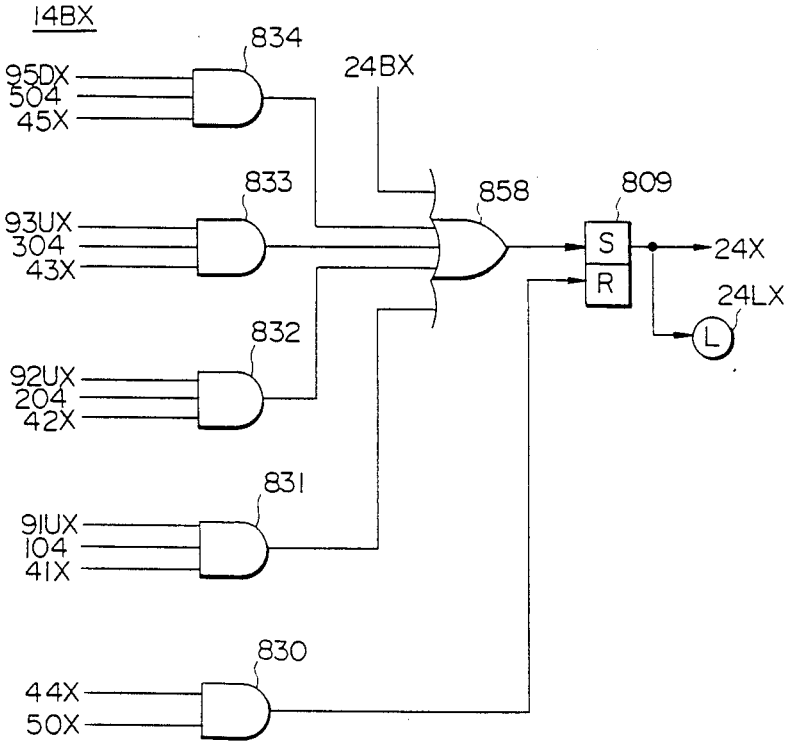
FIG. 6 is a circuit diagram of the portion of the cage call registration circuit of the cage No. 1 corresponding to the fourth floor.

When, on the third floor, passengers have got on and off the cage No. 1 and the cage has begun to close its door, the door opening/closure command signal 59X becomes "H" in FIG. 5. Since, at this time, the door closure is not completed, the full closure signal 54X is "L", the output of the NOT gate 875 becomes "H" and the output of the AND gate 827 becomes "H". Since the third-floor up preferential cage signal 93UX of the cage No. 1 is "H", the up call cancellation command signal 55UX of the third floor is rendered "H" by the AND gate 828. Thus, the output of the OR gate 851 in FIG. 3 becomes "H", so that both the memories 803 and 806 are reset. The fourth-floor destination call registration signal 304 becomes "L" to release the registration of the fourth-floor destination call, and the fourth-floor destination button lamp 4B is put out. Besides, when the third-floor up call registration signal 33U becomes "L" to release the registration of the third-floor up call, the third-floor up allotment signal 33UX of the cage No. 1 is reset to "L" by the allotment circuit 13C.

At a time immediately before the cage No. 1 completes the door closure, the call response process signal 61X becomes "L". Therefore, the output of the AND gate 821 in FIG. 4 becomes "L", the output of the NOT gate 871 becomes "H", and the memory 807 is reset, so that the third-floor up preferential response cage signal 93UX of the cage No. 1 becomes "L". Meanwhile, the output of the AND gate 835 in FIG. 7 becomes "L", and the arrival display command signal 56UX*a* becomes "L". Therefore, the output of the AND gate 837 becomes "L", and also the output of the OR gate 859 becomes "L", so that the up lamp 11UX of the third floor is put out. When the cage No. 1 has completed the door closure, the full closure signal 54X in FIG. 5 becomes "H". Therefore, the output of the AND gate 827 becomes "L", and the up call cancellation command signal 55UX of the third floor being the output of the AND gate 828 becomes "L", whereby the up call is permitted to be registered on the third floor again. When the cage No. 1 has completed the door closure and has reached the fourth floor after leaving the third floor, the third-floor cage position signal 43X becomes "L" and the fourth-floor cage position signal 44X becomes "H" in FIG. 6. When the cage No. 1 has been allocated to stop in response to the cage call 24X of the fourth floor and has stopped at the fourth floor, the at-stop signal 50X becomes "H". Therefore, the output of the AND gate 830 becomes "H", the memory 809 is reset, the fourth-floor cage call registration signal 24X becomes "L", and the fourth-floor cage call button lamp 24LX is put out to report that the cage has stopped in response to the cage call of the fourth floor.

The above is the operation executed when the assigned cage has arrived. Also in a case where a cage has arrived in response to a cage call only, it is selected as the preferential response cage and the arrival information is presented by the HL and the arrival chime likewise to the case of the assigned cage. However, when the unassigned cage (assumed to be the cage No. 1) has arrived in response to the cage call in the presence of the assigned cage (assumed to be the cage No. 2), the former cage is not selected as the preferential response cage. This time, therefore, the arrival display status command signal 58X*a* is rendered a pulse signal being "H" for 3 second and "L" for 0.5 seconds by means of the periodic pulse generator 58BX. After all, the third-floor up lamp 11UX flashes by turning 'on' for 3 seconds and 'off' for 0.5 second. In addition, since the output of the AND gate 840 remains at "L", the arrival chime 12BX does not ring. In this manner, in the presence of the assigned cage, the arrival display of the unassigned cage is presented in the different aspect, to prevent the user from mistaking the cage on which he/she is to get.

The following aspects of performance are also possible:

(a) As the aural information unit, a gong or a broadcasting information device based on voice may be employed rather than the chime.

(b) The invention may be applied to a system wherein destination floors are divided into two or more groups as to each of the up direction and the down direction and wherein one cage is assigned to each group (the information units may also be provided for the respective groups so as to present previous information).

(c) Destination buttons of the dial type or the ten-key type may be employed as means for appointing destination floors in a hall.

(d) The visual previous display aspects are not restricted to the different colors, but may be based on unequal brightnesses or display areas or on flashing display.

(e) An identical information unit may be used as the aural information units for the previous information and for the arrival information.

As thus far described, according to this invention, in an elevator wherein the hall of a floor to be served by a plurality of cages is furnished with destination buttons, and the cage calls of destination floors corresponding to the destination buttons are automatically registered for any of the cages, and wherein the destination floors in an up direction or those in a down direction are combined into groups so as to register calls for the respective groups in accordance with the destination buttons by call registration means, the cages are assigned to the respective registered group calls by assignment means, and the assigned cages are displayed before the arrival thereof by information units disposed in the hall; a hall information system for an elevator in which the information unit is operated on the basis of an assignment signal from the assignment means and a call registration signal corresponding to each destination floor from the call registration means, each time the call registration signal is output anew. Therefore, even in a case where another destination floor belonging to the same group has already been registered, the user of the elevator is prevented from feeling anxiety.

What is claimed is:

1. A hall information system for an elevator having a hall operation panel including a plurality of destination buttons corresponding to a plurality of destination floors, call registration means for registering a hall call and a destination call and delivering call registration signals respectively corresponding to the hall call and the destination call on the basis of a command generated in response to each actuation of a destination button on the hall operation panel, assignment means for generating a cage assignment signal on the basis of the hall call registration signal, cage call registration means for automatically registering the destination call corresponding to the destination button depressed by a user of the elevator, the destination calls being combined into at least one group in each of up and down directions as a cage call of an assigned cage, and an information unit disposed in each hall providing a cage indicating display to indicate in advance information as to arrival of cage assigned by the assignment means to serve the registered cage calls, said hall information system further including a control means for operating the information unit in response to actuation of a destination button and the corresponding cage assignment signal to activate the cage indicating display in a first predetermined fashion to identify the cage assigned to serve an initial registered call and to change the display in a second predetermined fashion different from the first in response to each subsequent actuation of a destination button and the corresponding cage assignment signal of said assignment means and call registration signal of said call registration means to provide the same display change when a registered call corresponding to each such subsequent actuation of the destination button is combined with other registered calls in a group served by the same assigned cage in order to indicate by the same display change the same cage assigned to serve each subsequent grouped call.

2. A hall information system according to claim 1 in which said information unit includes visual signalling means including up and down direction lanterns and aural signalling means including chimes.

3. A hall information system for an elevator having a hall operation panel including a plurality of destination buttons corresponding to a plurality of destination floors, call registration means for registering a hall call and a destination call and delivering call registration signals respectively corresponding to the hall call and the destination call on the basis of a command generated in response to each actuation of a destination button on the hall operation panel, assignment means for generating a cage assignment signal on the basis of the hall call registration signal, cage call registration means for automatically registering the destination call corresponding to the destination button depressed by a user of the elevator, the destination calls being combined into at least one group in each of up and down directions as a cage call of an assigned cage, and an information unit disposed in each of the elevator halls providing a cage arrival display for displaying in advance information as to arrival of the cages assigned by the assignment means to serve the registered cage calls, said hall information system further having a control means for operating each information unit to change the cage arrival display in response to each subsequent actuation of a destination button and the corresponding cage assignment signal of said assignment means and call registration signal of said call registration means in order to indicate by the display change the cage assigned to serve each call, said information units including hall lanterns to provide the cage arrival display and said control means controlling the hall lanterns to light in a first predetermined fashion when corresponding cages are assigned and to light in a second predetermined fashion different from the first in response to actuation of a destination button and delivery of a corresponding destination call registration signal of a destination floor belonging to the same group of destination calls, said hall lanterns including two types of lamps: a first lamp for indicating that a corresponding cage has been assigned by said assignment means, and a second lamp for indicating that the call has been registered by said call registration means.

4. A hall information system for an elevator as defined in claim 3 further comprising a pulse generator responsive to the destination call registration signal generated in response to each actuation of a destination button and delivery of a call registration signal for providing a pulse signal of predetermined duration to said second lamp so as to light it for a predetermined time.

5. A hall information system for an elevator as defined in claim 3 wherein said first lamp and said second lamp have emission colors different from each other.

6. A hall information system for an elevator as defined in claim 3 further comprising arrival display status setting means for generating an arrival pulse signal of a first predetermined duration in response to the arrival of the cage assigned by said assignment means to cause said first lamp to produce a light flash.

7. A hall information system for an elevator as defined in claim 6 wherein when a cage not assigned by said assignment means has arrived, said arrival display status setting means generates a pulse signal of a second predetermined duration different from the first predetermined duration to cause said first lamp to produce a light flash of the different duration.

8. A hall information system for an elevator having a hall operation panel including a plurality of destination buttons corresponding to a plurality of destination floors, call registration means for registering a hall call and a destination call and delivering call registration signals respectively corresponding to the hall call and the destination call on the basis of a command generated in response to each actuation of a destination button on the hall operation panel, assignment means for generating a cage assignment signal on the basis of the hall call registration signal, cage call registration means for automatically registering the destination call corresponding to the destination button depressed by a user of the elevator, the destination calls being combined into at least one group in each of up and down directions as a cage call of an assigned cage, an information unit disposed in each hall providing a cage arrival display to display in advance information as to arrival of the cages assigned by the assignment means to serve the registered cage calls,, each of said information units including hall lanterns providing the cage arrival display, said control means controlling the hall lanterns to light in a first predetermined fashion to indicate that corresponding cages have been assigned and to change the display and light in a second predetermined fashion different from the first in response to each subsequent actuation of a destination button and delivery of a corresponding destination call registration signal of a destination floor belonging to the same group of destination calls.

9. A hall information system for an elevator having a hall operation panel including a plurality of destination buttons corresponding to a plurality of destination floors, call registration means for registering a hall call and a destination call and delivering call registration signals respectively corresponding to the hall call and the destination call on the basis of a command generated in response to each actuation of a destination button on the hall operation panel, assignment means for generating a cage assignment signal on the basis of the hall call registration signal, cage call registration means for automatically registering the destination call corresponding to the destination button depressed by a user of the elevator, the destination calls being combined into at least one group in each of up and down directions as a cage call of an assigned cage, and an information unit disposed in each hall providing a cage arrival display having both aural and visual signalling means to display in advance information as to arrival of the cages assigned by the assignment means to serve the registered cage calls, said hall information system further including a control means for operating the information unit in response to actuation of a destination button and the corresponding cage assignment signal to activate both aural and visual signalling means of the cage arrival display to identify the cage assigned to serve an initial registered call and to activate both the aural and visual signalling means to change the cage arrival display in response to each subsequent actuation of a destination button and the corresponding cage assignment signal of said assignment means and call registration signal of said call registration means when a registered call corresponding to each such subsequent actuation of the destination button is combined with other registered calls in a group served by the same assigned cage in order to indicate by the display change the same cage assigned to serve the initial and each subsequent call, the cage arrival display including chimes providing the aural signalling means, and said control means controlling the visual signalling means to provide in a first predetermined display to indicate that corresponding cages have been assigned and change the display to provide a second predetermined display different from the first in response to actuation of a destination button and delivery of a corresponding destination call registration signal of a destination floor belonging to the same group of destination calls, said chimes including two types of chimes: a first chime which is rung responsive to the assignment signal generated by said assignment means and which is rung responsive to the destination call signal generated anew during the delivery of the assignment signal, and a second chime which is rung responsive to the arrival of the cage assigned by said assignment means.

10. A hall information system for an elevator as defined in claim 9 wherein said first chime is operated to ring in a single tone, while said second chime is operated to ring in a multiple tone.

* * * * *